United States Patent [19]

Oden

[11] Patent Number: 4,705,176

[45] Date of Patent: Nov. 10, 1987

[54] ARTICLE VENDOR WITH ADJUSTABLE COLUMN TRANSFER PROVISION FOR ACCOMODATING LOCALLY-PREVALENT SPACE-TO-SALES RATIO

[75] Inventor: Kenneth W. Oden, Charles Town, W. Va.

[73] Assignee: Dixie-Narco, Ranson, W. Va.

[21] Appl. No.: 880,730

[22] Filed: Jul. 1, 1986

[51] Int. Cl.[4] ..... A47F 7/28

[52] U.S. Cl. ..... 211/59.2; 312/45; 221/176

[58] Field of Search ..... 211/59.2, 14, 15; 221/67, 176, 112; 312/45, 49, 42, 72, 73, 121, 124

[56] References Cited

U.S. PATENT DOCUMENTS

| | | |
|---|---|---|
| 1,984,070 | 12/1934 | La Vercombe . |
| 2,115,620 | 4/1938 | Cave . |
| 2,205,192 | 6/1940 | Fry . |
| 2,255,007 | 9/1941 | Greene et al. . |
| 2,256,976 | 9/1941 | Ford . |
| 2,338,714 | 1/1944 | Garner . |
| 2,399,105 | 4/1946 | Donaldson . |
| 2,913,142 | 11/1959 | Salisbury . |
| 2,957,605 | 10/1960 | Gabrielsen . |
| 3,043,474 | 7/1962 | Mullin . |
| 3,146,908 | 9/1964 | Perri et al. . |
| 3,169,621 | 2/1965 | Johnson et al. . |
| 3,547,312 | 12/1970 | Ambrose . |
| 3,561,640 | 2/1971 | Thompson . |
| 3,680,937 | 8/1972 | Steeley . |
| 4,509,658 | 4/1985 | Oden . |

*Primary Examiner*—Ramon S. Britts
*Assistant Examiner*—Blair M. Johnson
*Attorney, Agent, or Firm*—Cushman, Darby & Cushman

[57] ABSTRACT

A column vendor for articles such as generally cylindrical containers of beverage typified by cans or bottles of soft drinks is provided with an inexpensive and reliable way of being reconfigured to fit the particular distribution of popularity of brands/flavors or the like of articles, as experienced by the operator for the particular vendor. Openings are provided through intercolumn divider walls. In use, these openings are either closed by closure members, or fitted with shunt, cam or floor plates for effecting particular column transfers. In use, these members are static; adjustment can involve rearrangement, substitution, augmentation and removal of these members which preferably are hooked in place either on edges of the openings or in slots or other securement features provided on the intercolumn divider walls.

24 Claims, 9 Drawing Figures

Fig. 1
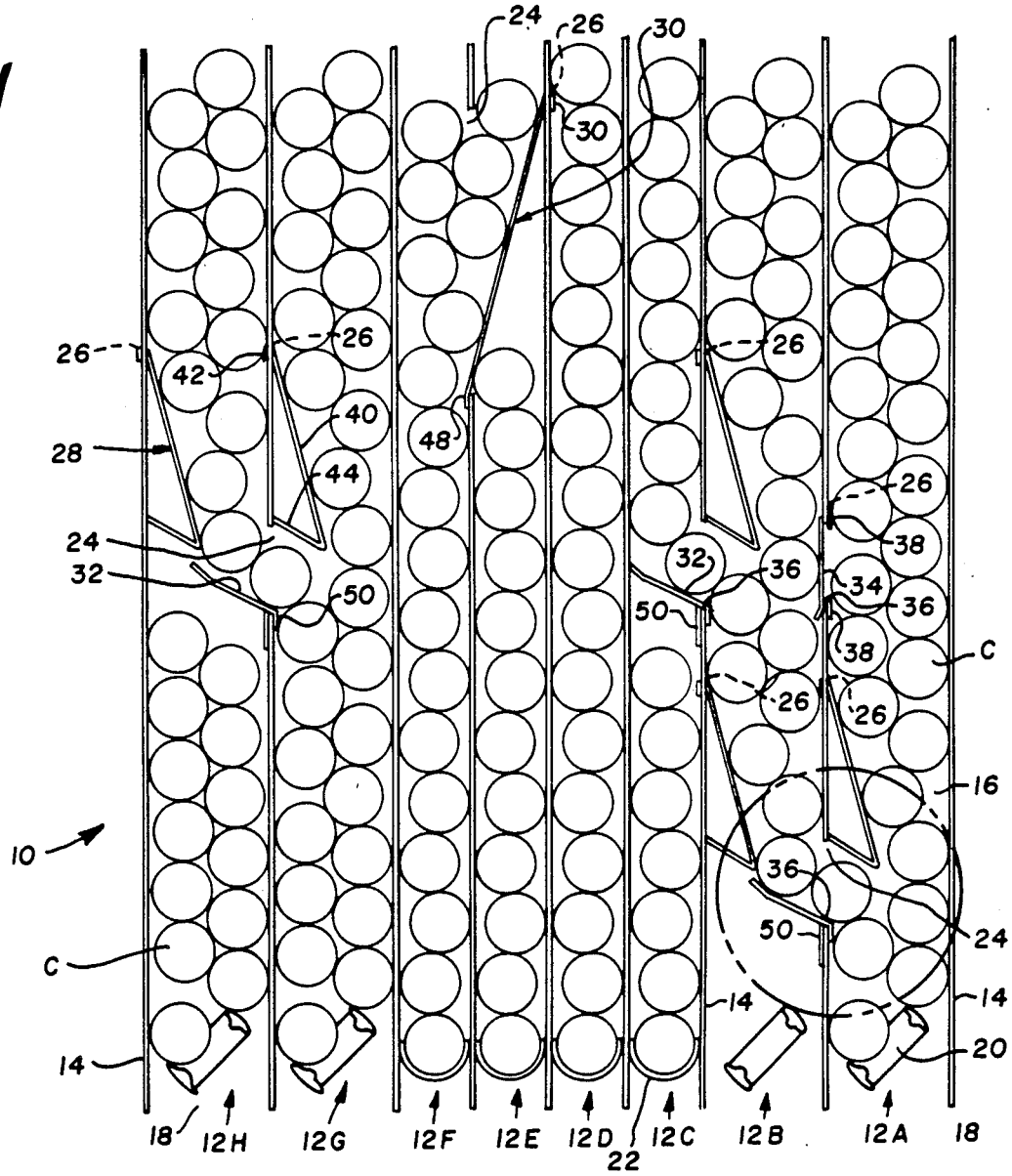
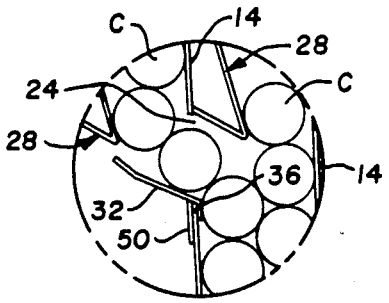
Fig. 2a
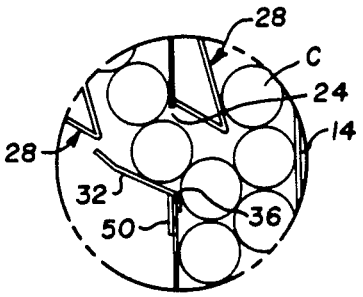
Fig. 2b

Fig. 3a
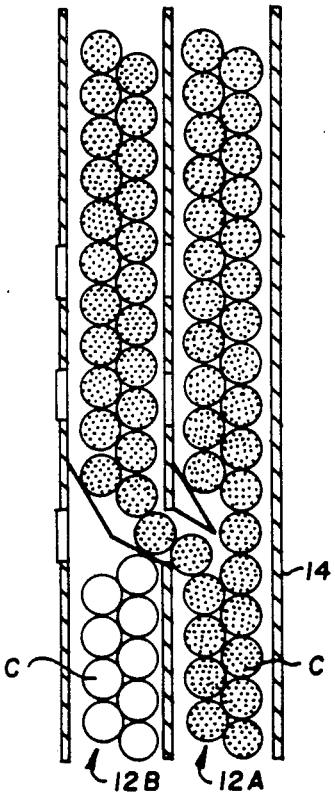
Fig. 3b
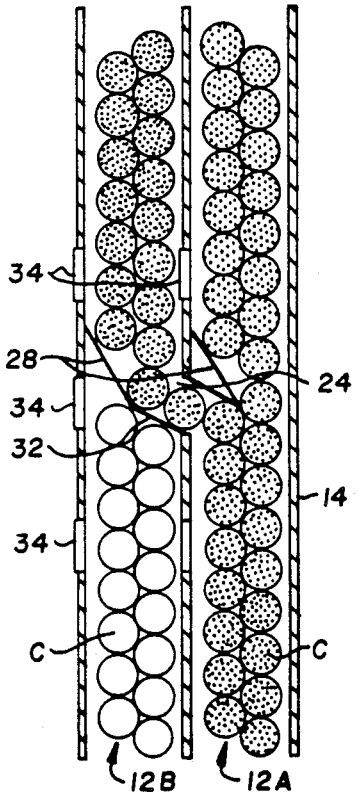
Fig. 3c
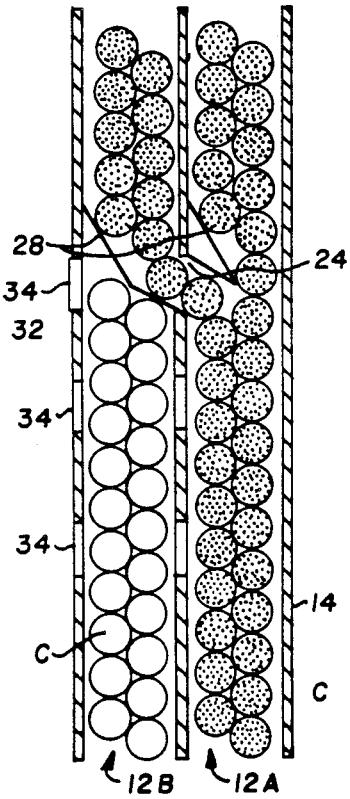
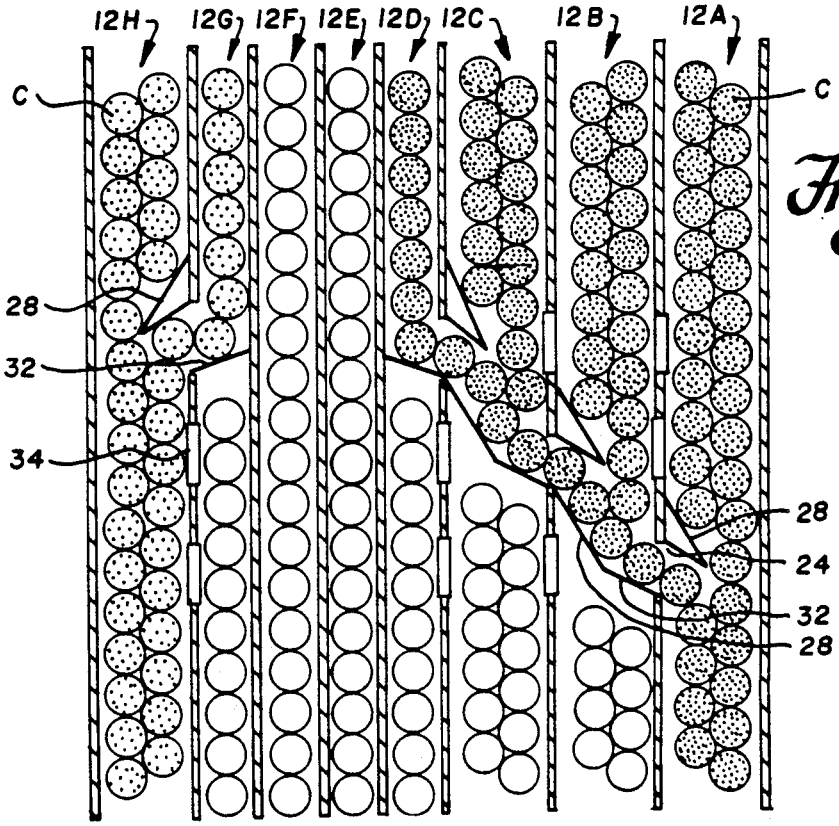
Fig. 4a

ARTICLE VENDOR WITH ADJUSTABLE COLUMN TRANSFER PROVISION FOR ACCOMODATING LOCALLY-PREVALENT SPACE-TO-SALES RATIO

BACKGROUND OF THE INVENTION

The present invention arose in the particular context of vendors for bottles and/or cans of beverages such as soft drinks and, while it is disclosed herein primarily in relation to that context, it should be clearly understood that the principles of the invention have broader applicability and may be used with other articles having sufficiently similar dynamics, as will be appreciated by those skilled in the article vendor art.

Of the several types of mechanized article-vendors which have been devised, one which is in particularly widespread use, especially for vending rollable generally cylindrical bottles and/or cans of beverages such as soft drinks is the so-called column vendor.

In a rudimentary or architypical form a conventional column vendor comprises an enclosure, often called a cabinet or box, having a principal face, generally its front, which usually features in a lower region at least one outlet port for vended articles, a control panel which generally includes at least one site where the intending user may insert some form of credit or payment such as coins, a sheet of paper money or a credit card, at least one selector usable for selecting among two or more different brands, flavors, sizes or other characteristics of the articles available for vending, and one actuator (which may be combined with the selector) for initiating operation of the vendor to vend a selected article for which a form of payment has been inserted. Often the control panel as well as other panels on the principal face, and other faces of the column vendor bear logos or other indicia indicative of and/or tending to promote the selection of one or more of the brands and/or flavors of articles usually contained in the vendor. Any of a whole host of other features may be provided on the prinicpal face of the box, including without limitation change-making devices, slug-bent coin rejectors, light and/or sound emitting sales-promotional devices and the like.

Within the cabinet of such a typical column vendor are a plurality of vertical columns generally in one rank which extends transversally of the principal face, but sometimes two or more ranks deep front-to-back. At a minimum, each column includes wall means for confining and supporting a stack of articles, means for permitting articles to the stack, and means operatively connected between a mechanical, electro-mechanical or fully electronic 'brain' housed in the cabinet, and an outlet port for abstracting an article from the stack and supplying it to the outlet port upon receipt of a signal which in effect indicates that an intending user has inserted a sufficient payment, has selected an article contained in that column and has requested actuation of the vendor to furnish such an article to the outlet port.

In the typical column vendor, at least for beverages, the space within the cabinet is refrigerated so that the bottles or cans of beverage, when vended, are cold and ready to provide cool refreshment.

Quite frequently in column vendors, the stack of articles in a column is one-article wide (although there may be zig-zag staggering of the articles in order to maximise use of space in the cabinet) and the stack is supported from below by a conventional arrangement which includes a device to temporarily transfer the site of application of stack support to the next-to-lowest article as the lowest article is vended to the outlet port, e.g. by rotation of a cradle portion of a principal support, after which the application of stack support is retransferred to the principal support permitting the stack to correspondingly lower.

The vendor cabinet has a lockable door through which access may be gained to the cabinet interior only by authorized maintaince and service personnel, e.g. for making repairs and adjustments, collecting accumulated forms of payment and refilling the columns with articles to be vended. Often, the principal face of the vendor is provided on that door or at least on the same side of the vendor as is that door. And usually, the individual columns are designed to be refilled from the front, or from the top by starting from the existing lowermost article (or from the principal support if the particular column is completely empty) and building the stack article by article until the particular stack is full or the service person has exhausted his or her supply of the article belonging in that stack.

Over the years, knowledge and lore has accumulated in the article vending trade as to the relative popularity generally, regionally and locally of various brands and flavors of articles to be vended, for instance, soft drinks. A typical route person who has serviced a particular soft drink vendor for an extended period can forecast with a respectable degree of confidence the ratio of cans of cola to orange soda to lemon-lime soda that will have been vended from that machine since his or her last visit and so be able to load up his or her hand-truck with a corresponding profile of cases of warm soft-drink for refilling the machine. It is a knack born of necessity, since the person who is poor at such forecasting will be found lugging much more merchandise both to and from the delivery truck and having to make more second trips to the delivery truck, both of which act as drags on efficiency.

In order to accomodate some of the disparity in brand/flavor popularity, many different tricks-of-the-trade and machine design features have been devised. Perhaps most rudimentary of these practices, often used on machines where each column has its own stack support cradle and each selector button or position on the vending panel is connected to a distinct stack support cradle, is to fill the stacks for slow-selling brands/flavors only part-way full, but the stacks for fast-selling brands/flavors all of the way full (and often also to devote more than one column to the fast-selling brands/favors). Then, the service person may fill the empty spaces in the respective columns above the stacks of slow-selling brands/flavors (and perhaps other spaces within the refrigerated cabinet) with containers of the faster-selling brands/flavors of product. In this manner an advantage can be gained, since, at the time of the next refilling of the machine the service person can manually transfer already cold containers of the fast-selling brands/flavors from the 'wrong' to the 'right' columns, after which the remaining column space can be filled with warm containers of product as before. In this manner, a service person can restock the machine with somewhat less frequency than if only the 'right' containers were ever placed in the respective columns, and yet be assured that customers will neither find the machine to be 'out' of their desired beverage or the like, nor that can or other container when received from the vending machine to contain warm beverage or the like due to insufficient time of residence of the respective container in the vendor cabinet prior to its being vended. Of course, if the vendor was used abnormally frequently, and/or the service person was delayed abnormally long from one visit to the next, the intending user could still find his or her brand/flavor sold out or, what is worse, could deposit his or her money, make a selection, and instead of a container of the selected brand/flavor of product, receive one of the containers that the service person had sandbagged in a 'wrong' column in anticipation of his or her next restocking of the machine.

At the vendor designer/manufacturer level, the various equipment modifications that have been deivsed for accomodating disparity of brand/flavor popularity have included (in addition to the aforementioned provision of more than one column and thus more than one selector or selector position devoted to a popular brand/flavor), some other doubling-up or column transfer techniques such as connecting two or more columns to the same selector or selector position on the selector panel in such a manner that containers are vended alternately or in some established pattern of succession from the functionally interconnected columns. Another technique which has been devised is to interconnect two columns at some point above the bottom in such a manner that containers can transfer from one column to an adjacent column as that adjacent column tends to become empty.

In a typical such arrangement of the latter type, one column may be provided at half-height with an elevated floor, and above that floor a 'trap-door' leading to an adjoining column, for effectively converting two adjoining columns into a half-column for a less-popular brand/flavor of product and a one-and-one-half column for a more-popular brand/flavor of product. Such arrangements are shown in the following U.S. patents:

| Patentee | U.S. Pat. No. | Issue Date |
|---|---|---|
| Donaldson | 2,399,105 | Apr. 23, 1946 |
| Johnson et al | 3,169,621 | Feb. 16, 1965 |
| Thompson | 3,561,640 | Feb. 9, 1971 |

Other arrangements for causing a container which is stored in one column to be dispensed from a port which serves another column, e.g. by bodily shifting all or part of that column are shown in the following U.S. patents:

| Patentee | U.S. Pat. No. | Issue Date |
|---|---|---|
| Fry | 2,205,192 | Jun. 18, 1940 |
| Greene et al | 2,255,007 | Sep. 2, 1941 |
| Salisbury | 2,913,142 | Nov. 17, 1959 |

Quite often the aforementioned prior art vendor structural arrangements were for accomodating space-to-sales were adjustable and/or reversible which is considered to be an attractive feature, inasmuch as it provides a means for being flexible, within a given vending machine, so as to permit the operator to tailor the columns to allot more space to faster-selling items, and less space to slower-selling ones. This need is particularly strong in an age where brand segmentation is producing a proliferation of beverages under the same brand, a growing number of new strongly-promoted beverages e.g. teas, fruit juices, and soft drinks containing some proportion of real fruit juice, and in an age where some changes in ownership of brands may result in unaccustomed realignments of varieties of soft drinks expected to be vended from the same machines. It is also important where the machine over its expected lifetime, is expected to be in service at a succession of locations where different profiles of brand/flavor preference are likely.

The present inventor and his associates have experimented with various configurations of the active 'trap-door'-type of column transfer mechanism which has been referred to above, only to find the usefulness of such mechanicsms to be overly limited, in that, if the 'trap-door' is not near the top of a column, the weight of the cans or bottles being held back will push out the door and, in essence, both stop downward travel of the principal stack in the principal column and also inhibit transfer of the auxiliary stack to the principal column. More complex active gates provided at lower levels of the columns also have proved to be a disappointment. Although they may eliminate the problem of 'fighting' or precedence between the stack in the principal column and the stack in the auxiliary column, when the complex active gate is finally released the sudden cascade of cans or bottles into the principal column causes many complications that have proved difficult to solve.

The present invention was devised in order to provide the advantages of prior art column transfer devices, without the drawbacks which have been described.

SUMMARY OF THE INVENTION

A column vendor for articles such as generally cylindrical containers of beverage typified by cans or bottles of soft drinks is provided with an inexpensive and reliable way of being reconfigured to fit the particular distribution of popularity of brands/flavors or the like of articles, as experienced by the operator for the particular vendor. Openings are provided through intercolumn divider walls. In use, these openings are either closed by closure members, or fitted with shunt, cam or floor plates for effecting particular column transfers. In use, these members are static; adjustment can involve rearrangement, substitution, augmentation and removal of these members which preferably are hooked in place either on edges of the openings or in slots or other securement features provided on the intercolumn divider walls.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 1 is a somewhat schematic fragmentary front elevational view of the column and stack support portions of a beverage can vendor provided with adjustable column transfer features according to principles of the present invention. (Structure omitted from this view may be utterly conventional; e.g. the cabinet may be one as shown in the Steeley, U.S. Pat. No. 3,680,937, issued Aug. 1, 1972; the stack support/article vendor cradles may be constructed and operated as disclosed in the Oden, U.S. Pat. No. 4,509,658, issued Apr. 9, 1985; and the general arrangement of the vendor may be as disclosed in any of a number of prior U.S. patents exemplified by those listed as references in the above-mentioned patents of Steeley and Oden, as well as in other prior U.S. patents, the Gale, U.S. Pat. No. 3,158,247 issued Nov. 4, 1964 being selected as a particular example in an illustrative, non-limiting sense and the Johnson, U.S. Pat. No. 2,988,246 issued June 13, 1961 being selected as another such example.)

FIG. 2*a* is a fragmentary view showing the portion encircled by dash-dot lines in FIG. 1 at a different stage in a typical vending cycle; and FIG. 2*b* is a similar view showing the same portion at yet another stage.

FIGS. 3*a*, 3*b* and 3*c* are somewhat schematic front elevational views showing three alternate arrangements of two side-by-side double (i.e. 'tandem') columns using the adjustable column transfer features according to principles of the present invention.

FIGS. 4*a*, 4*b* and 4*c* are somewhat schematic front elevational views showing three alternate arrangements of the columns of an eight column vendor using the adjustable column transfer features according to principles of the present invention.

DETAILED DESCRIPTION

Figure 4B:
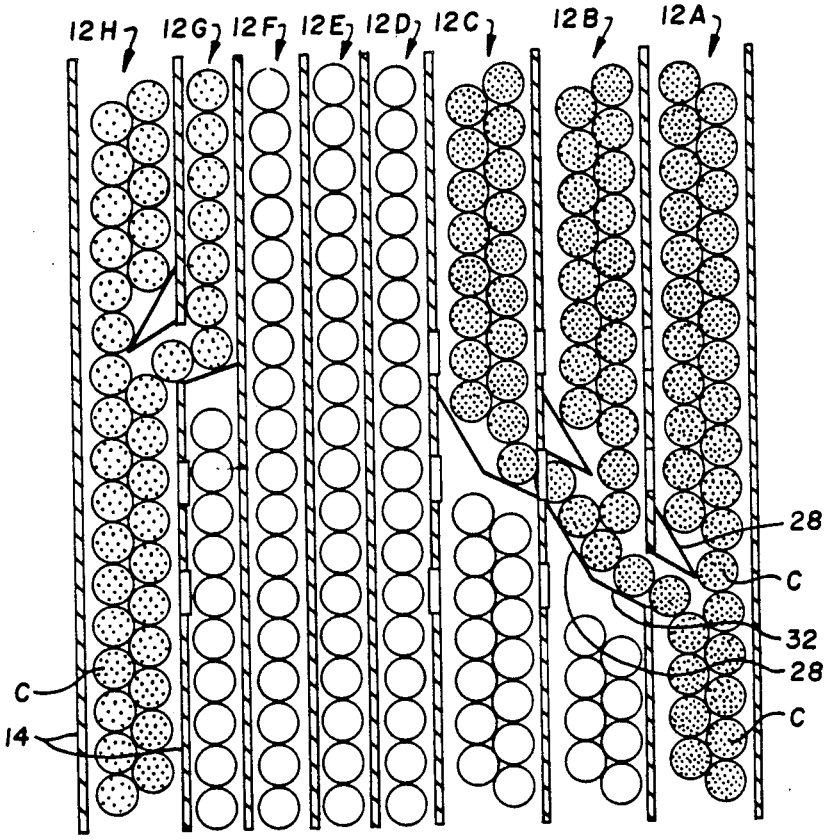

FIG. 1 shows in simplified form what a column vendor 10 might look like to a person who has opened its front door (not shown) and is looking at the front of the set of columns 12A–12H of the vendor. Structure not depicted in this view may be conventional, as indicated hereinabove with reference to disclosures of typical conventional vendors. This vendor happens to be one for vending cylindrical cans of soft drink, which will be used in the ensuing description by way of example.

The vendor 10 is an eight column vendor, which is a typical layout, the columns 12A–12H being arranged side-by-side transversally of the front of the vendor 10. The columns 12A–12H are vertical, and each is bounded at its two laterally opposite sides by respective sidewalls 14. In instances where a colunm 12A or 12H is at the extreme left of right of the bank of columns, its laterally outer wall 14 is unshared, but in other instances, each sidewall 14 is a dividing wall between two neighboring columns e.g. between 12A and 12B.

Each column 12A–12H is designed to be filled from the front and/or from the top by a succession of articles, in this instance cans C lying on their sides.

In the instance depicted in FIG. 1, which is a preferred arrangement, columns 12A, 12B, 12G and 12H are wide columns, i.e. so-called tandem columns which are slightly less than two cans wide, in order to accomodate a deeply-folded stack of cans C in which alternate cans rest in engagement with opposite sidewalls 14 of that column. In this instance, columns 12C–12F are narrow columns, each of which is only slightly wider than a single can, in order to accomodate a substantially unfolded, or only slightly folded stack of cans C, in which alternate cans rest in engagement with one or the other of the opposite sidewalls 14, although not necessarily with the absolutely regular alternation which is depicted. (Regular alternation maximizes the packing density, i.e. the space utilization of the columns.)

In viewing FIG. 1, it is possible that what is seen is all that there is, in terms of depth of the vendor, but it is also possible, even likely, that behind the stacks of cans which can be seen is one or more additional ranks of stacks of cans, and the present invention is equally applicable to either situation. In any event, the sidewalls 14 are generally vertically oriented, are of metal sheet material or the like, as is conventional, with their thickness oriented transversally of the front of the vendor 10, and extending to a rear wall 16 from which they may be supported in whole or in part. Other structure which may be provided to strengthen the walls 14 and/or to help support them from other elements of the cabinet have been omitted for the sake of clarity.

Each column is shown served at its otherwise open bottom outlet 18 by a respective conventional mechanism 20 or 22 for supporting the respective stack of cans C and for, upon command, abstracting the lowermost can from the stack and delivering it to the outlet 18, while permitting the remainder of the respective stack to correspondingly lower, as the can delivered to the outlet 18 conventionally descends a chute (not shown) to an outlet port (not shown) from which it can be withdrawn by the intending customer.

Because some of the columns, for instance 12A, are almost double the width of others, for instance 12C, the vendor 10 is already conventionally suited to stock more of fast-selling brands/flavors of soft drink than of slow-selling brands/flavors. And that capability can be conventionally enhanced by providing more than one selector button or selector position on the selector panel (not shown) for fast-selling brands/flavors, thus giving the intending consumer a second chance for a popular drink should one of the columns containing cans of that drink become empty.

However, in addition to, or instead of the conventional techniques for customising the capacity of the vendor 10 to the locally prevalent popularity profile, the present invention provides convenient, highly-adaptable, rugged, relatively trouble-free and inexpensive means for transferring articles, e.g. cans, laterally from column to column at one or more sites above the level of the lowermost can in the respective stack.

In FIG. 1, as well as the other drawing Figures, the particular arrangements of the structures provided in accordance with the principles of the invention, while certainly possible ones, are not necessarily the ones that would be most typical or most usually encountered. Rather, in these views, the structures have been shown in positions calculated to help the interested viewer and reader to more easily understand the range of possibilities for adjustment using the apparatus and method principles of the invention.

The apparatus of the invention is shown including a number of preferably mountable/demountable elements, as well as certain modifications to the sidewalls 14, as will now be described.

The sidewall modifications include the fact that at least one of the sidewalls which also acts as an intercolumn divider is provided with an opening 24 which is at least slightly taller than the diameter of a can C and which is at least slightly deeper than the height (when upright) of a can C. Each of the openings 24 may extend completely to an adjacent front and/or rear edge of the respective sidewall C, or it may be formed as a slot through a central part of such sidewall.

The sidewall modifications also include a plurality of anchor sites, e.g. slots 26 for permitting the preferably removable attachment of the elements which are further described below. These slots 26 preferably are provided not only in the intercolumn divider walls 14, but also in the laterally outermost sidewalls 14.

The mountable/demountable elements are shown including cams 28, ramps 30, slanted floors 32 and closure plates 34. (In any particular installation more or less than all of these elements may be used, and more or less than any one of them than has been illustrated may be used.)

Each closure plate 34 is designed to hook into one or more slots 26 above an opening 24 and to hook onto the ledge 36 of the respective opening, using its hooks 38 so as to effectively close that opening for so long as the machine is configured in the particular manner, i.e. the plate 34 does not intermittantly or periodically open or act as a gate during use of the vendor as depicted.

Each cam 28 comprises a sheet that is bent back on itself so as to provide an oblique declining surface 40 having a hook 42 at the top by which that cam 28 is mounted in the slot or slots 26 of a respective sidewall, and a foot 44 which engages the same sidewall in order to cause the lower edge of the oblique declining surface 40 to stand off from that respective sidewall by a fixed distance amount.

In the instance depicted, the cams 28 are provided for use in the wide columns, the foot 44 causes the lower edge to stand out nearly to the diameter of a can C from the respective sidewall, the surface 40 is about three can diameters in length, and the foot 44 angles upwards from horizontal so that when a cam 28 is used in juxtaposition with an underlying slot 26 in the same sidewall 14, the foot 44 engages that sidewall immediately over the respective opening 24.

The ramps 30 are designed to be used with taller ones of the openings 24, i.e. ones substantially taller than the diameter of one can, e.g., without limitation, ones which are 2–6 cans in height. A ramp 30 has a hook means 46 at the top for hooking into one or more slots 26 in one sidewall 14 across from an opening 24 in the opposite sidewall 14 of the same column, and a hook or ledge means 48 at the bottom for lapping over the lower lip of the opening 24 in that opposite wall of the same column. The main portion of the ramp slants between the hook means and ledge means thereof fully across the respective column.

Each of the slanted floors 32 is cantilevered upwards and across at a slant from an inverted channel 50 which embraces a lower lip of a respective opening 24. The lateral extent of a slanted floor is the full width of a narrow column and somewhat more than half the width of a wide column.

The structures may be used in conjunction with one another in the various combinations and juxtapositions shown, and in others also.

An overview of the provision of the structures in the various positions and combination shown in FIG. 1 will now be provided.

As a basis of comparison, it may be noted first that single column 12D is neither closed-off height-wise nor ported to an adjacent column at any place throughout its height, as an illustration that some of the columns in the set may be utterly conventional. The same effect can be achieved even for a column which has openings 24 in either or both of its sidewalls, by closing those openings with respective closure plates 34. The sidewalls 14 of the column 12D may nonetheless be provided with slots 26 at various levels, as may the sidewalls of all of the columns, both for use by structures mounted in the adjoining columns for which these walls are party walls, and also for use by structures which may be mounted at other times in the particular column in question.

The wide columns 12A and 12B and the narrow column 12C are shown set-up to shunt all of the cans in columns 12A and 12B and the cans from the top half of column 12C to the stack support 20 for the outlet 18 of column 12A. Typically, these two and one-half columns would hold cans of a comparatively fast-selling soft drink, such as regular Coke® or regular Pepsi®. The bottom half of column 12C is set to dispense cans of a comparatively unpopular soft drink via the stack support 22 and outlet 18 of column 12C. Typically, this half-column would hold cans of a comparatively slow-selling soft drink, such as generic grape soda.

Narrow columns 12E and 12F are shown set-up to vend all of column 12F and the top one-quarter of column 12E via the stack support 22 and outlet 18 of the column 12F, but the contents of the lower three-fourths of column 12E via the stack support 22 and outlet 18 of the column 12E.

Columns 12G and 12H, both wide columns are shown set-up to vend all of the contents of column 12G and the contents of the upper half of column 12H via the stack support 20 and outlet 18 of the column 12G, and the contents of the lower half of column 12H via the stack support 20 and outlet 18 of the column 12H.

All of the bracket-like members 28, 30, 32 which shunt the cans from one column to an adjacent column and/or isolate an upper part of a column from the lower part of that column, and the bracket-like members 34 which close-off openings 24 between adjoining columns by preference are simple brackets, shelves or the like, e.g. made of sheet metal or molded engineering plastic material, with the hooks or grooves shown being fabricated or molded into them for permitting them to be mounted, preferably removably mounted to the sidewalls of the columns.

It is very important to notice that the structures and method of the present invention facilitate use of old product before new in each column, i.e. inventory management on a first-in/first-out basis. In addition to the benefits mentioned above, the problem of first-in/first-out is of prime importance to the syrup companies because they do not want old product to stay in the machines. With the apparatus of the present invention, no matter how far the columns have been emptied, one simply places the new product at the top of the primary and secondary columns and the new product will take its turn being vended out. In the vendor of the Thompson, U.S. Pat. No. 3,561,640 or any gate concept, even the shifting column concepts shown in Green, U.S. Pat. No. 2,255,007 or Fry, U.S. Pat. No. 2,205,192, such a problem is present. If one comes back to the machine to reload it when the primary column has been vended down approaching the gate but has not opened the gate, one will be adding product back into the prime column and the secondary column will just rest there. If this happens too many times, one will have stale product in the secondary column. If one approaches the machine after the primary column has passed the gate and part of the secondary column has been vended out, one will have to manipulate the structure in order to get the gate closed and load both the primary column and secondary column. The proper way would be to unload the secondary column into the primary column and then load fresh product into the secondary column, but in practice, one cannot depend on service personnel taking the time to do this in the field.

Where the vendor 10 is a double-depth or other multiple-depth vendor, the structures of the invention may be independently provided and used at any and all of the levels, i.e. front and rear, or front, middle and rear, etc.

In concept, a column having an operative support 20 or 22, i.e. one which is connected with a selector button or selector position on the selector panel of the vendor via the control mechanism of the vendor, may be considered to be a 'primary column', and a column or column portion which originally contains a can that must transfer to another column in order to be vended may be considered to be a 'secondary column'.

By strong present preference, the present invention as put to use involves no active gates for achieving secondary column to primary column transfer, i.e. no gate which pivots, slides, swings, deflects or otherwise must move from one position to another in order to permit the column-to-column transfer to take place. The cans siimply flow from the secondary column to the primary column as suggested in the circled region 60 of FIGS. 1, 2*a* and 2*b*, which has been found in practice so far to be more reliable than waiting for a primary column to become empty down to the level of a closed, active gate which then releases and lets cans from the secondary column into the primary column through the opened gate.

Taking a parting look at FIG. 1, when a wide column, such as column 12H is transferring to a wide column such as column 12G, a small shelf-like bracket 34 is clamped on the lower lip of the opening 24 in the wall 14 between columns 12G and 12H and two diversion devices 28 are hung on the walls so that the nested cans C in these wide columns form relatively unfolded single stack segments which neatly nest as a highly folded stack in wide column 12G below the respective opening 24. Not only is the need for working gates eliminated, but also, freedom is gained as to where to provide the opening or openings 24 in each cloumn-divider wall 14, because there is no longer a question of pressure on a necessarily active gate. In fact, one can go to the extreme which is depicted near the bottoms of columns 12A and 12B, where all of columns 12A and 12B, and an upper part of column 12C are devoted to one fast-selling product. In a modular vendor, this permits the drive motor for the support 2 of column 12B to be omitted (or, if already installed, removed and used elsewhere) with corresponding savings.

Other arrangements using the structures and method of the present invention are depicted in FIGS. 3*a*–3*c* and 4*a*–4*c*. Supports such as 20 or 22 which would be provided as is described above in relation to FIG. 1 are simply omitted from FIGS. 3*a*–3*c* and 4*a*–4*c*. Other elements are given numerals corresponding to those used in FIG. 1, and redescription is omitted here. The different types of shading used on the various cans C is intended to permit the viewer to readily distinguish cans of three different brands/flavors of soft drink from one another. These FIGS. 3*a*–3*c* and 4*a*–4*c* do depict a preferred placement for openings 24 i.e. three vertically spaced ones in each column divider wall which is a party wall for a wide column and another column.

Assuming the vendor depicted in FIGS. 3*a*–3*c* is a double-depth vendor of which only the frontal bank is visible, the capacity of the vendor with the set-up shown in FIG. 3*a* is twenty of the non-stippled variety of cans and one hundred-sixteen of the heavily stippled variety of cans. The comparable figures for the set-up shown in FIG. 3*b* are thirty-two non-stippled cans and one hundred-four heavily stippled cans, and for the set-up shown in FIG. 3*c* are forty-four non-stipppled cans and ninety-two heavily stippled cans.

The column capacity (in number and percent) of the vendor of FIGS. 4*a*, 4*b* and 4*c* and with all of the openings 24 closed and the other brackets of the invention removed (i.e. of a conventional eight column vendor for comparison) are shown in the following table:

TABLE 1

Figure 4C:
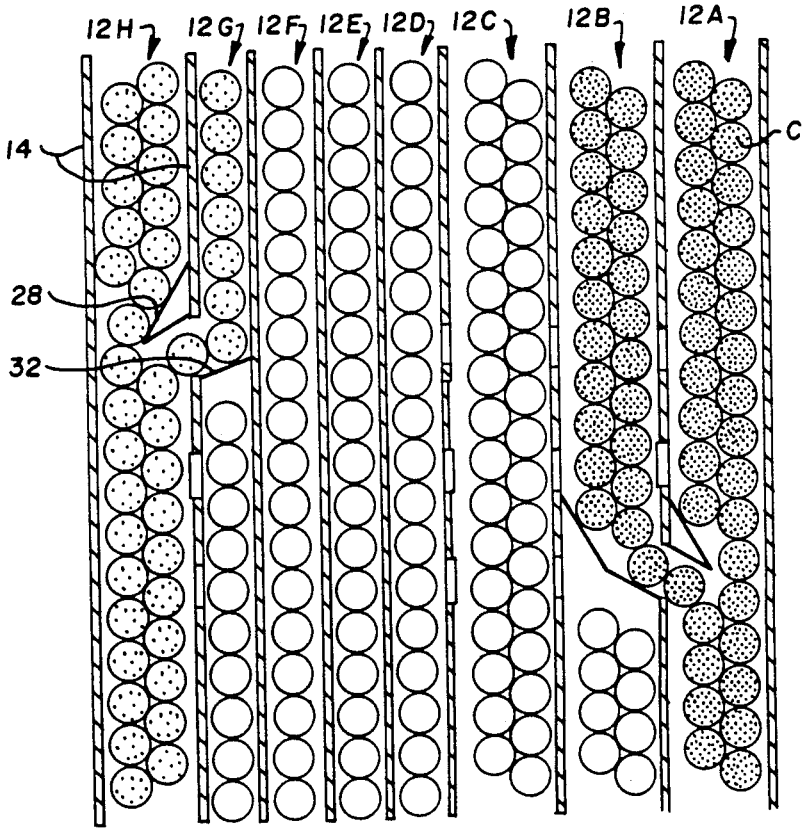

| | COLUMN | | | | | | | | |
|---|---|---|---|---|---|---|---|---|---|
| SET UP | 12H | 12G | 12F | 12E | 12D | 12C | 12B | 12A | TOTAL |
| Conventional | 72(16%) | 38(9%) | 38(9%) | 38(9%) | 38(9%) | 72(16%) | 72(16%) | 72(16%) | 440 |
| FIG. 4a | 82(19%) | 22(5%) | 38(9%) | 38(9%) | 22(5%) | 32(8%) | 20(5%) | 168(40%) | 422 |
| FIG. 4b | 82(19%) | 22(5%) | 38(9%) | 38(9%) | 38(9%) | 32(8%) | 20(5%) | 152(36%) | 422 |
| FIGS. 4C | 82(16%) | 22(5%) | 38(9%) | 38(9%) | 38(9%) | 72(17%) | 20(5%) | 116(27%) | 426 |

In FIGS. 4*a*–4*c*, the three different degrees of stippling are intended to illustrate cans of three respectively different brands/flavors of soft drink.

For the sake of clarity, it should be noted that in their current form, FIGS. 3*a*–4*c* are computer-generated schematic views, in which the relationships of the cans to the sidewalls of the banks of columns is not shown as accurately as in FIGS. 1–2*b*, in that, in practice the sidewalls are actually engaged by the cans at opposite sides of the stack.

It should now be apparent that the article vendor with adjustable column transfer provision for accomodating locally-prevalent space-to-sales ratio as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A column transfer arrangement for use in a vendor for generally cylindrical articles such as cans of soft drink, which vendor has a bank of transversally spaced, vertically oriented columns each defined between two laterally opposite sidewalls, each two columns which adjoin one another in said bank of columns sharing a respective said sidewall, and the vendor further including a stack support means disposed at the base of each said column from which articles are to be dispensed directly to an outlet chute, said column transfer arrangement comprising:

means defining at least one opening through at least one of said shared sidewalls, said opening being sized to permit lateral passage therethrough of a said article from one said column to an adjacent said column; and for each said opening, there being provided alternately useful means mountable to said bank of columns for:

(a) closing said opening; and (b) shunting articles contained in one said column above this shunting means, laterally through said opening, into said adjacent column, both said alternately useful closing means and shunting means being adapted to remain static while in use;

each said alternately useful means being adapted to be mounted to at least one respective said sidewall and each said sidewall of said one column and of said adjacent column including mounting means for mounting said alternately useful means thereto;

said mounting means on said sidewalls of said one column and of said adjacent column including at least one of:

slots through the respective said sidewalls, and perimetrical lips of respective of said openings; and each of said alternately useful means being adapted to be mounted to respective of said sidewalls by being provided with at least one of hook means and channel means respectively for mounting with said slots and said lips.

2. The column transfer arrangement of claim 1, wherein:

said at least one opening through at least one said shared sidewall comprises a plurality of vertically spaced said openings through at least one of said shared sidewalls.

3. The column transfer arrangement of claim 1, wherein:

both said sidewalls and said alternately useful means are made of sheet metal.

4. The column transfer arrangement of claim 1, wherein:

each said shunting means slopes obliquely downwards from juxtaposition with one sidewall of said one column to juxtaposition with a lower lip of a respective said opening in the respectively opposite said sidewall of said one column.

5. The column transfer arrangement of claim 1, wherein:

said sidewalls of said one column are spaced laterally apart by a distance which is slightly greater than the width of each said article to be stacked therein and substantially less wide than twice the width of each said article.

6. The column transfer arrangement of claim 1, wherein:

said sidewalls of said one column are spaced laterally apart by a distance which is substantially wider than the width of each said article to be stacked therein and slightly less wide than twice the width of each said article.

7. The column transfer arrangement of claim 6, wherein:

said sidewalls of said other column are spaced laterally apart by a distance which is substantially wider than the width of each said article to be stacked therein and slightly less wide than twice the width of each said article; and said column transfer arrangement further includes a camming means arranged to be mounted in said other column proximally of a respective said opening through a respective said sidewalls shared by said one column and said other column, for causing a deeply folded stack portion of said articles contained in said other column above said respective opening to unfold, while descending, into proximity with the opposite said sidewall of said other column proximally of said respective opening in order to permit a succession of articles transferring from said one column to said other column through said respective opening to intercalate with said stack portion of said articles unfolded by said camming means, to thereby reform in said other column a deeply folded stack of said articles for descent below said respective opening.

8. The column transfer arrangement of claim 7, wherein:

said at least one opening through at least one said shared sidewall comprises a plurality of vertically spaced said openings through at least one of said shared sidewalls.

9. The column transfer arrangement of claim 7, wherein:

each said alternately useful means is adapted to be mounted to at least one respective said sidewall and each said sidewall of said one column and of said adjacent column includes mounting means for mounting said alternately useful means thereto.

10. The column transfer arrangement of claim 9, wherein:

said mounting means on said sidewalls of said one column and of said adjacent column include at least one of slots through the respective said sidewalls and perimetrical lips of respective of said openings; and each of said alternately useful means is adapted to be mounted to respective of said sidewalls by being provided with at least one of hook means and channel means respectively for mounting with said slots and said lips.

11. The column transfer arrangement of claim 10, wherein:

both said sidewalls and said alternately useful means are made of sheet metal.

12. The column transfer arrangement of claim 7, wherein:

each said shunting means slopes obliquely downwards from juxtaposition with one sidewall of said one column to juxtaposition with a lower lip of a respective said opening in the respectively opposite said sidewall of said one column.

13. The column transfer arrangement of claim 12, wherein:

said sidewalls of said one column are spaced laterally apart by a distance which is slightly greater than the width of each siad article to be stacked therein and substantially less wide than twice the width of each said article.

14. The column transfer arrangement of claim 7, wherein:

said camming means includes a laterally obliquely extending cam plate hooked to the respective said sidewall shared by said one column and said other column above the respective said opening, this cam plate having a lower edge which is disposed below an upper lip of the respective said opening, and a support foot engaged between said cam plate and said sidewall shared by said one column and said other column nearer said upper lip than where said cam plate is hooked to the respective said sidewall.

15. A column transfer arrangement for use in a vendor for generally cylindrical articles such as cans of soft drink, which vendor has a bank of transversally spaced, vertically oriented columns each defined between two laterally opposite sidewalls, each two columns which adjoin one another in said bank of columns sharing a respective said sidewall, and the vendor further including a stack support means disposed at the base of each said column from which articles are to be dispensed directly to an outlet chute, said column transfer arrangement comprising:

means defining at least one opening through at least one of said shared sidewalls, said opening being sized to permit lateral passage therethrough of a said article from one said column to an adjacent said column; and for each said opening, there being provided alternately useful means mountable to said bank of columns for:

(a) closing said opening; and (b) shunting articles contained in one said column above this shunting means, laterally through said opening, into said adjacent column, both said alternately useful closing means and shunting means being adapted to remain static while in use;

each said shunting means sloping obliquely downwards from juxtaposition with one sidewall of said one column to juxtaposition with a lower lip of a respective said opening in the respectively opposite said sidewall of said one column;

said sidewalls of said one column being spaced laterally apart by a distance which is slightly greater than the width of each said article to be stacked therein and substantially less wide than twice the width of each said article;

said sidewalls of said other column being spaced laterally apart by a distance which is substantially wider than the width of each said article to be stacked therein and slightly less wide than twice the width of each said article; and said column transfer arrangement further including a camming means arranged to be mounted in said other column proximally of a respective said opening through a respective said sidewall shared by said one column and said other column, for causing a deeply folded stack portion of said articles contained in said other column above said respective opening to unfold, while descending, into proximity with the opposite said sidewall of said other column proximally of said respectively opening in order to permit a succession of articles transferring from said one column to said other column through said respective opening to intercalate with said stack portion of said articles unfolded by said camming means, to thereby reform in said other column a deeply folded stack of said articles for descent below said respective opening.

16. The column transfer arrangement of claim 15, wherein:

each said alternately useful means is adapted to be mounted to at least one respective said sidewall and each said sidewall of said one column and of said adjacent column includes mounting means for mounting said alternately useful means thereto.

17. The column transfer arrangement of claim 15, wherein:

said at least one opening through at least one said shared sidewall comprises a plurality of vertically spaced said openings through at least one of said shared sidewalls.

18. The column transfer arrangement of claim 3, wherein:

said mounting means on said sidewalls of said one column and of said adjacent column include at least one of slots through the respective said sidewalls and perimetrical lips of respective of said openings; and each of said alternately useful means is adapted to be mounted to respective of said sidewalls by being provided with at least one of hook means and channel means respectively for mounting with said slots and said lips.

19. The column transfer arrangement of claim 18, wherein:

both said sidewalls and said alternately useful means are made of sheet metal.

20. The column transfer arrangement of claim 15 wherein:

each said shunting means slopes obliquely downwards from juxtaposition with one sidewall of said one column to juxtaposition with a lower lip of a respective said opening in the respectively opposite said sidewall of said one column.

21. The column transfer arrangement of claim 20, wherein:

said sidewalls of said one column are spaced laterally apart by a distance which is slightly greater than the width of each said article to be stacked therein and substantially less wide than twice the width of each said article.

22. The column transfer arrangement of claim 20, wherein:

said sidewalls of said one column are spaced laterally apart by a distance which is substantially wider than the width of each said article to be stacked therein and slightly less wide than twice the width of each said article.

23. The column transfer arrangement of claim 15, wherein:

said camming means includes a laterally obliquely extending cam plate hooked to the respective said sidewall shared by said one column and said other column above the respective said opening, this cam plate having a lower edge which is disposed below an upper lip of the respective said opening, and a support foot engaged between said cam plate and said sidewall shared by said one column and said other column nearer said upper lip than where said cam plate is hooked to the respective said sidewall.

24. A column transfer arrangement for use in a vendor for generally cylindrical articles such as cans of soft drink, which vendor has a bank of transversely spaced, vertically oriented columns each defined between two laterally opposite sidewalls, each two columns which adjoin one another in said bank of columns sharing a respective said sidewall, and the vendor further including a stack support means disposed at the base of each said column from which articles are to be dispensed directly to an outlet chute, said column transfer arrangement comprising:

means defining at least one opening through at least one of said shared sidewalls, said opening being sized to permit lateral passage therethrough of a said article from one said column to an adjacent said column; and for each said opening, there being provided alternately useful means mountable to said bank of columns for:

(a) closing said opening; and (b) shunting articles contained in one said column above this shunting means, laterally through said opening, into said adjacent column, both said alternately useful closing means and shunting means being adapted to remain static while in use;

said at least one opening through at least one shared sidewall comprising a plurality of vertically spaced said openings through at least two adjacent ones of said shared sidewalls, and as to a respective said opening through each of said two adjacent ones of said shared sidewalls, for which a respective said column at one lateral extreme is a said one column relative to a respective middle one of said columns, a respective said column at an opposite lateral extreme being a said other column relative to said middle column, and said middle column being a said other column relative to said column at one lateral extreme and being a said one column as to said column at said opposite lateral extreme, said sidewalls of said other column being spaced laterally apart by a distance which is substantially wider than the width of each said article to be stacked therein and slightly less wide than twice the width of each said article; and said column transfer arrangement further including a camming means arranged to be mounted in said other column proximally of a respective said opening through a respective said sidewall shared by said one column and said other column, for causing a deeply folded stack portion of said articles contained in said other column above said respective opening to unfold, while descending, into proximity with the opposite said sidewall of said other column proximally of said respective opening in order to permit a succession of articles transferring from said one column to said other column through said respective opening to intecalate with said stack portion of said articles unfolded by said camming means, to thereby reform in said other column a deeply folded stack of said articles for descent below said respective opening.

* * * * *